US005123170A

United States Patent [19]

Enrique

[11] Patent Number: 5,123,170

[45] Date of Patent: Jun. 23, 1992

[54] ELLIPSOGRAPH AS A DRAFTING TOOL

[76] Inventor: Castaneda-Mori Enrique, 1338 Lance Dr., Santa Rosa, Calif. 95401

[21] Appl. No.: 655,671

[22] Filed: Feb. 14, 1991

[51] Int. Cl.[5] ..... B43L 11/04

[52] U.S. Cl. ..... 33/30.1

[58] Field of Search ..... 33/30.1, 30.4, 30.6, 33/30.7, 31, 27.08

[56] References Cited

U.S. PATENT DOCUMENTS 520,003 5/1894 Lehner ..... 33/30.4

731,018 6/1903 Carlton ..... 33/30.1

2,315,479 3/1943 Schwartz ..... 33/30.1 X 2,636,271 4/1953 Lacois ..... 33/30.4 X

*Primary Examiner*—Harry N. Haroian

*Attorney, Agent, or Firm*—Larry D. Johnson

[57] ABSTRACT

An ellipsograph including a connecting rod carrying a collinear rotary end, scriber, and reciprocating end. The rotary end provides rotation about selected circumferences for that end of the connecting rod, while the reciprocating end permits reciprocating movement in response for that end of the connecting rod. Adjustable block members enable selective location of at least the scriber and reciprocating end on the connecting rod. A base portion supports the rotary end and reciprocating end on the drafting material.

2 Claims, 2 Drawing Sheets

ELLIPSOGRAPH AS A DRAFTING TOOL

BACKGROUND OF THE INVENTION

1. Field of the Invention

This invention relates generally to drafting tools and accessories, and more specifically to an improved ellipsograph device.

2. Description of the Prior Art

Most draftsmen and illustrators still use ellipse templates rather than ellipsographs because known ellipsographs are undesirable as drafting tools, for a variety of reasons:

a) lack of simplicity in operation;
b) lack of accuracy;
c) inability to draw small ellipses (e.g. 1/16");
d) inability to draw large ellipses (e.g. greater than 4");
e) inability to produce ellipses with variable minor axis;
f) complexity of structural configuration;
g) incompatible size;
h) tendency to get stuck;
i) use of needles, which causes damage to the table and the drafting paper; and
j) they do not have ways of indicating where to set them in order to draw the ellipses exactly in the right place.

SUMMARY OF THE INVENTION

The drafting tool of the present invention provides an ellipsograph comprising a connecting rod carrying a collinear rotary end portion, scriber portion, and reciprocating end portion. The rotary end provides rotation about selected circumferences for that end of the connecting rod, while the reciprocating end permits reciprocating movement in response for that end of the connecting rod. Adjustable block members enable selective location of at least the scriber and reciprocating end on the connecting rod. A base portion supports the rotary end and reciprocating end on the drafting surface.

The present invention is based upon a simple premise: a straight single line A—B can generate perfect ellipses if, simultaneously, point A follows a rotating (circular) path; while point B reciprocates back and forth along a radial. Thus, each of the remaining points on line A—B will describe a perfect but different ellipse. (No two ellipses described by the points on line A—B are exactly alike, because the minor axis varies in accord with each point position). Thus, geometrically, only point A will describe a circle, point B a straight line, and each of the remaining points on line A—B will describe a perfect ellipse with the same major axis, but with different minor axis. The minor axis will be larger when the drawing point (on line A—B) is closer to the rotating end, and it will be shorter when the point is closer to the reciprocating end. The circular path's diameter will always be equal to the ellipse's major axis.

A first embodiment of the invention is capable of drawing all kinds of ellipses with a major axis up to approximately one foot. For ellipses bigger than one foot, connecting rod extensions could be added. A second embodiment is designed for extremely small ellipses, having a major axis from about one-sixteenth inch up to two inches.

In order to draw ellipses with precise minor axes length, the scriber location on the connecting rod should be settled at the same major-minor axes ratio of the ellipse to be drawn. For example, if the distance A—B on the connecting rod scale is forty and the ellipse to be drawn should have a major axis = twelve and a minor axis = six (a fifty percent ratio), then the scriber position should be set at that same percentage (at fifty percent of the distance forty) which is twenty on the connecting rod scale.

Thus, the drafting tool of the present invention provides an accurate, reliable, and simple ellipsograph which is as practical and easy to use as the compass to trace circles. The inventive device is capable of tracing precise ellipses of any size and shape to help artists, illustrators, architects, drafters, students, technical institutions, many industries, and all kinds of engineering offices.

DETAILED DESCRIPTION OF A PREFERRED EMBODIMENT

Figure 1:
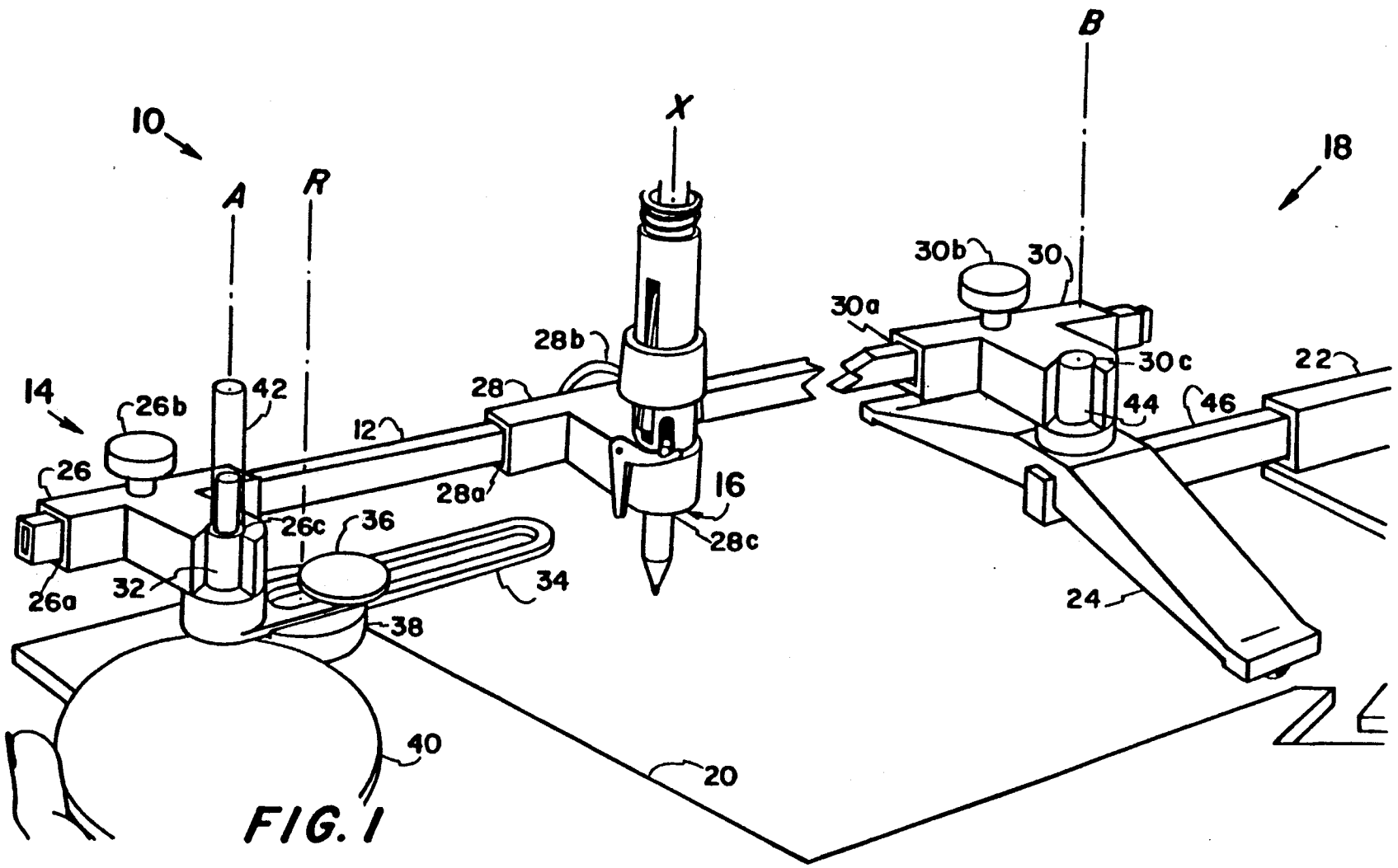
FIG. 1 is a partially cutaway perspective view of the first embodiment of the drafting tool of this invention, used for drawing ellipses having a major axis up to one foot (or more) in size.

FIG. 1 is a partially cutaway perspective view of the first embodiment of the drafting tool of this invention, used for drawing ellipses having a major axis up to one foot (or more) in size. The basic parts of the first embodiment 10 of the ellipsograph of this invention are:

a) the connecting rod 12 on which the rotary end portion 14, the scriber portion 16 and the reciprocating end portion 18 are attached;

b) the rotary end 14, which includes a crank of variable arm length attached to one end of the connecting rod 12 and attached to the base portion 20;

c) the reciprocating end 18, which is locked at the other end of the connecting rod 12 and able to slide back and forth along a straight guide member 22, and is also attached to the base 20;

d) the scriber 16 which is located and locked where it is needed on the connecting rod; and e) the base 20 which is the ellipsograph's resting lower part, and is joined to the upper part by the rotary end 14 and reciprocating end 18.

The Connecting Rod

The connecting rod 12 is a non-flexible bar, on which the rotary end 14, the scriber 16 and reciprocating end 18 are located and locked. Connecting rods may have a male end and a female end to couple with each other as extensions, whenever it is needed (extensions would be used to obtain bigger ellipses, or very rounded ones). For a better stability and to prevent wrong movements that could affect the ellipse accuracy, it is preferable to use single connecting rods, plus a heavy transverse supporter 24, rather than a pair of rods in parallel.

Blocks

The rotary end 14, the scriber 16, and the reciprocating end 18 each include a block portion 26, 28, 30, respectively. All blocks have the same horizontal cavity 26*a*, 28*a*, 30*a*, respectively, into which the connecting rod 12 will fit. Blocks will be able to be moved and locked wherever they are needed on the connecting rod as, for example, by locking screws 26b, 28b, 30b. The blocks must also have a vertical bore 26c, 28c, 30c, respectively, equidistant from the horizontal cavities to the centers into which the rotary end pin, the pen holder, or the reciprocating end pin (respectively) will be inserted, as described infra. These components will create the basic straight line A—B.

The Rotary End

The purpose of the rotary end 14 is to give its arm a specific length and the rotation necessary to generate the ellipse. The rotary end consists of the block 26, a pin 32, an arm 34, an arm locking nut 36, a shaft 38, and a driver gear 40. The arm length is the circular path's radius, or in other words, it is the distance from the rotary pin axis to the shaft axis (from point A to point R). A friction wheel or special gear forms the shaft 38. It has less diameter, but is taller than the driver gear. To avoid movements other than rotational, the shaft should be well fitted in the base 20 (and ma preferably include bearings). The shaft may have a groove to accommodate the slotted arm, allowing the arm to slide in order to change the circular path's radius. On the top of the shaft should be printed a small radial line (at 90 degrees to the arm) for reading the arm scale. A dot in the shaft center should also be shown as a reference point. Some interchangeable arm pieces, of different lengths, may be used especially when very round and small ellipses are required. A handle 42 is a tubular piece inserted to the upper part of the pin. It ma be used for the arm rotation around the shaft axis, which is all that is needed to trace an ellipse with the device. The driver gear is operated with a finger and mechanically or frictionally meshes with the shaft, but it is rarely used. Its purpose is to increase the effort arm when the handle is hard to turn (this only happens when very small ellipses are traced; as the circle path gets so small, that the effort arm becomes negligible).

The Reciprocating End

The reciprocating end 18 consists of the block 30, the supporter 24 with a pin 44, the sliding bar 46, and the guide 22. The purpose of the reciprocating end when it is locked to the connecting rod is to slide back and forth inside the guide, which is fixed to the base 20. The function of the supporter is to prevent wrong movements and assist the balance of the device. In addition:

a) the block should be locked to the connecting rod;

b) for better stability, the pin 44 and the block bore 30b should be of low frictional material, in order to pivot around smoothly and evenly (load changes are expected when extensions are used, but providing an adjustable counterweight system is not practical);

c) the sliding bar must also be accurately fitted and be able to be moved with very little friction into its guide; and d) the supporter must be keyed to the bar.

The Scriber

The scriber 16 could be modified in accordance with the kind of work that the ellipsograph is performing. It could consist of simply a drilled hole to hold a pen, a pencil or a knife, or it could be threaded to accommodate a rapidograph or similar device. But, to hold pencils or pens of different diameters, it could consist of the block and a pen holder. The holder is encased in another tube fixed to the block, which has some vertical slots as guides for the pencil grabbers. The most important requirements for tracing perfect ellipses include:

a) the axis of the tool used to trace the ellipse has to be aligned with line A—B, in other words, the pen point has to be at the holder's center line;

b) the holder (and the pen) should also be able to be lifted from the paper until everything is set; and c) the scriber must also have a way of giving the holder and the pen the pressure necessary to be capable of drawing (a fine coil spring has been used for this purpose in the first embodiment).

The Base

The main purpose of the base 20 is to hold and keep the ellipsograph aligned with respect to the direction of the ellipses major axis. The base would not be necessary in some special jobs, as with fixed ellipsographs that would be attached directly to the table below. The rotary end and the reciprocating end are joined to the base's lateral sides. When the device is assembled, line A—B would be created, in which the rotary end pin axis would be point A and the reciprocating end pin axis would be point B. The scriber (point X) will be at some selected point between points A and B, and the shaft axis is point R. Whenever the arm and connecting rod get parallel to each other, point R also becomes aligned along the major axis. The base is preferably expandable to accommodate rod extensions when desired.

Figure 2:
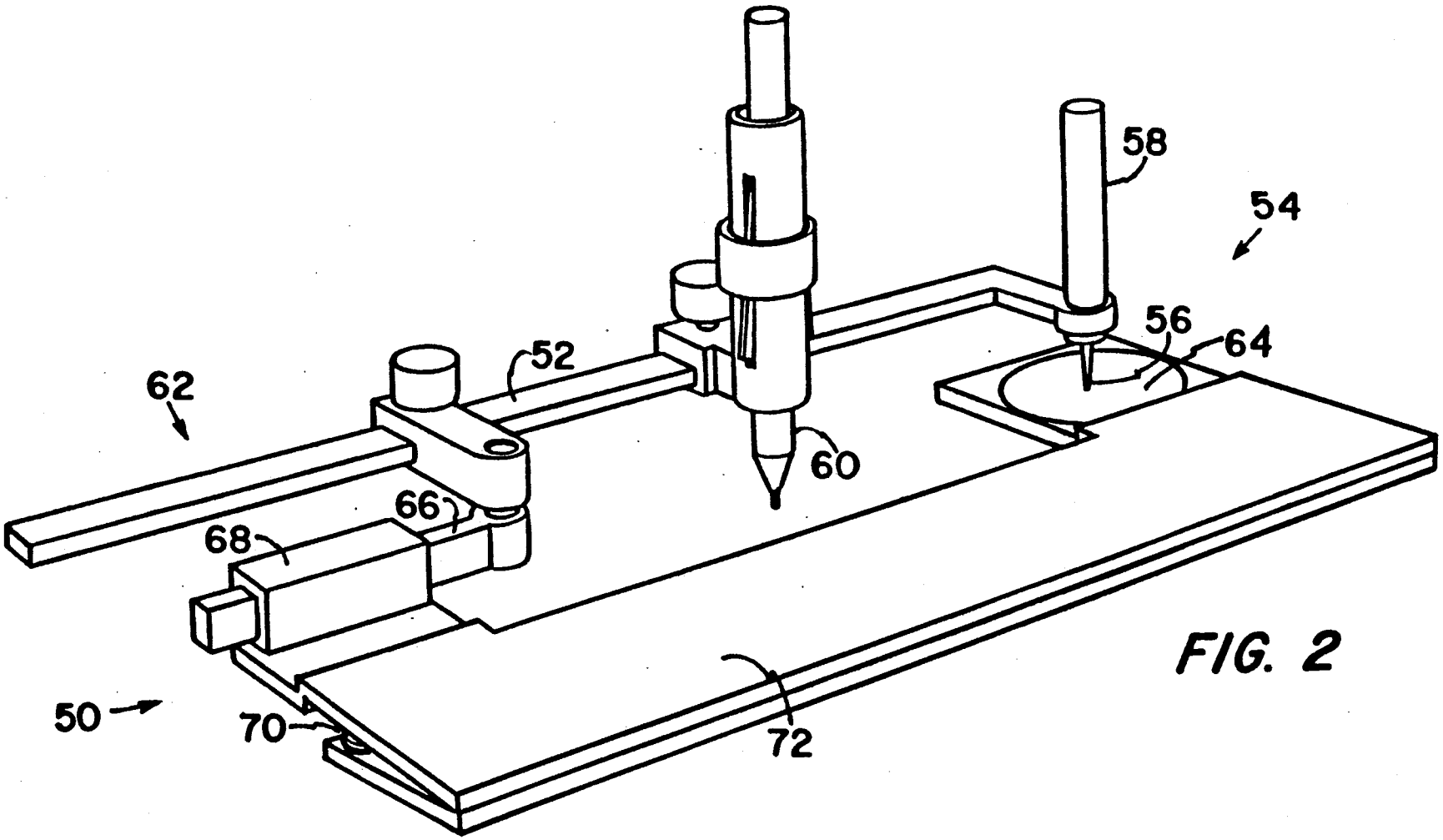
FIG. 2 is a perspective view of the second embodiment of the drafting tool of this invention, used for drawing ellipses having a major axis generally less than two inches in size.

FIG. 2 is a perspective view of the second embodiment of the drafting tool of this invention, such as would be used for drawing ellipses generally less than two inches in size. Aside from the scale difference between the two designs, there are some other variations, nevertheless, the principle remains exactly the same. (Note: the ordering of the operative components as illustrated in FIG. 2 has been reversed from that in FIG. 1, demonstrating the reversibility of the system).

The Connecting Rod

The connecting rod 52 still carries the reciprocating end and scriber, has been bent to form the rotary end 54, and includes a follower-needle 56, with a handle 58 at the top, which is aligned with the scriber 60 and reciprocating end 62 axes.

The Rotary End

The needle 56 replaces the whole rotary end of the regular design The needle follows the proper circular groove at the bottom to provide the rotation necessary to generate an ellipse. A group of concentric grooves serves as a template. Its circles have diameters from one-sixteenth inch up to two inches. They are engraved in an interchangeable plate 64 that may be substituted for another with a different circle size or diameter or others with concentric icons, such as gears, hexagons, stars, etc. for their perspective.

The Reciprocating End

The reciprocating end 62 does not require a supporter as with the first embodiment. In addition, the smaller design is a unit and does not use rod extensions. Instead, the sliding bar 66 can turn around 180 degrees to be inserted at the other end of the guide 68 in order to increase the line A—B distance when this is required.

The Scriber

Being fixed to the block, the scriber 60 of the small model has no up and down movements like the first embodiment; instead, spring(s) 70 in the base 72 gives the ellipsograph a small inclination, keeping the scriber lifted until it is all set. Then the base should be pressed down to trace the ellipse.

The small design is very simple and fast to use: with the needle resting on the groove's center, find the ellipse's center, by putting the pencil point over the axes intersection, then press the base gently and follow the chosen groove with the needle. A perfect and well centered ellipse is traced in this way, which has a major axis equal to the groove's diameter and a minor axis according to the scriber position (between the needle and the reciprocating end).

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. An ellipsograph for drawing, engraving or cutting out ellipses on a drafting material, said ellipsograph comprising:

a rotary end portion;

a scriber portion including means for drawing a line on said drafting material;

a reciprocating end portion;

a connecting rod having a length extending between said rotary end portion and said reciprocating end portion, said connecting rod attached to said reciprocating end portion by a first adjustable block member enabling selective positioning of said reciprocating end portion along said connecting rod length, and said connecting rod attached to said scriber portion by a second adjustable block member enabling selective positioning of said scriber portion along said connecting rod length; and a base portion for supporting said rotary end portion and said reciprocating end portion on said drafting material, wherein when said rotary end portion is rotated about a selected circumference, said reciprocating end portion moves in reciprocating motion in response to such rotation, and said scriber portion draws an ellipse on said drawing material.

2. The ellipsograph of claim 1 wherein said connecting rod is attached to said rotary end portion by a third adjustable block member enabling selective positioning of said rotary end portion along said connecting rod length.

* * * * *